US005364746A

United States Patent [19]

Inoue et al.

[11] Patent Number: 5,364,746

[45] Date of Patent: Nov. 15, 1994

[54] DEVELOPER FOR SILVER HALIDE PHOTOGRAPHIC LIGHT-SENSITIVE MATERIAL

[75] Inventors: Kenichi Inoue; Tsuyoshi Mitsuhashi, both of Hino, Japan

[73] Assignee: Konica Corporation, Japan

[21] Appl. No.: 216,765

[22] Filed: Mar. 23, 1994

Related U.S. Application Data

[63] Continuation-in-part of Ser. No. 46,439, Apr. 12, 1993, abandoned.

[30] Foreign Application Priority Data

Apr. 13, 1992 [JP] Japan ..... 4-92947

[51] Int. Cl.[5] ..... G03C 5/305

[52] U.S. Cl. ..... 430/488; 430/464; 430/480; 430/490; 430/481

[58] Field of Search ..... 430/464, 486, 488, 490, 430/480, 481

[56] References Cited

U.S. PATENT DOCUMENTS

| | | | |
|---|---|---|---|
| 3,628,955 | 12/1971 | Haist et al. | 430/488 |
| 4,141,734 | 2/1979 | Lenoir et al. | 430/488 |
| 4,254,215 | 3/1981 | Kramp et al. | 430/488 |

FOREIGN PATENT DOCUMENTS

| | | | |
|---|---|---|---|
| 3132649 | 6/1991 | Japan | 430/488 |

*Primary Examiner*—Hoa Van Le
*Attorney, Agent, or Firm*—Jordan B. Bierman

[57] ABSTRACT

A developer for developing a silver halide photographic material is disclosed. The developer comprises a compound represented by Formula 1 or Formula 2;

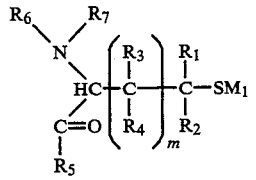

(1)

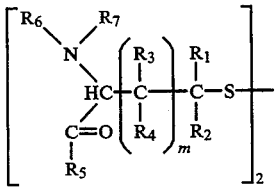

(2)

wherein $R_1$, $R_2$, $R_3$, and $R_4$ are each a hydrogen atom or an alkyl group having 1 to 3 carbon atoms provided that both of $R_1$ and $R_2$ are not hydrogen atoms at the same time; $R_5$ is a hydroxy group, an amino group or an alkyl group having 1 to 3 carbon atoms; $R_6$ and $R_7$ are each a hydrogen atom, an alkyl group having 1 to 5 carbon atoms, an acyl group having 1 to 18 carbon atoms or a $-COOM_2$ group, provided that both of $R_1$ and $R_2$ are not hydrogen atoms at the same time, in the above $M_1$ is a hydrogen atom, an alkali metal atom or an ammonium group; m is an integer 0, 1 or 2; and $M_2$ is a hydrogen atom, an alkyl group having 1 to 4 carbon atoms, an alkali metal atom, an aryl group or an aralkyl group having not more than 15 carbon atoms. Formation of silver sludge in the developer is prevented.

13 Claims, No Drawings

DEVELOPER FOR SILVER HALIDE PHOTOGRAPHIC LIGHT-SENSITIVE MATERIAL

This application is a continuation of application Ser. No. 46,439, filed Apr. 12, 1993, now abandoned, which claims the priority of Japanese 92947/1992, filed Apr. 13, 1992.

FIELD OF THE INVENTION

The present invention relates to a photographic developer, more specifically a developer for a silver halide photographic light-sensitive material capable of forming an image of high sensitivity and high density without silver sludge formation therein even when processed at low replenishing rates.

BACKGROUND OF THE INVENTION

Sulfites such as sodium sulfite and potassium sulfite, used as antioxidants for photographic developers, have an ability dissolving silver halide.

This results in the formation of a large amount of a sulfite-silver complex salt upon light-sensitive material processing, which complex salt elutes in the developer. The eluted silver complex is easily reduced by the developing agent, resulting in the accumulation of precipitated silver known as silver sludge.

In continuous processing using an automatic processing machine, this silver sludge, in suspension in the developer, adheres to the film and the rollers and belts of the automatic processing machine.

This can cause serious failures such as yellow-brown streak stains and flaws on the film being transported.

In recent years, processing solution retention in developing machine tanks has increased as the photographic processing solution replenishing rate has been reduced to meet the requirements related to environmental conservation. Thus the amount of silver sludge accumulated has increased.

Traditionally, there have been proposed a large number of arts for prevention of silver sludge, including Japanese Patent Publication Open to Public Inspection (hereinafter referred to as Japanese Patent O.P.I. Publication) No. 114035/1983, using a thiouracil, Japanese Patent O.P.I. Publication No. 2043/1988, using a mercaptobenzoic acid, Japanese Patent Examined Publication No. 14953/1972, using an aliphatic mercaptocarboxylic acid, Japanese Patent O.P.I. Publication No. 178959/1987, Japanese Patent O.P.I. Publication No. 51844/1991, using a disulfide, Japanese Patent O.P.I. Publication No. 26136/1971, using a sulfur-containing α-amino acid, and various mercaptoazoles, all of which are compounds likely to form a water-soluble silver salt.

However, many of these compounds have the following drawbacks, and few are satisfactory from the viewpoint of practical use.

1) Air oxidation degrades the sludge preventing effect of the compounds in the developer.

2) Large amounts must be used to obtain the desired sludge preventing effect.

3) Use in large amounts deteriorates film sensitivity and gamma value.

4) Malodor is generated.

5) Expensive for processing solutions.

There has been strong demand for the development of a new art free of these drawbacks.

SUMMARY OF THE INVENTION

It is an object of the present invention to provide a developer which allows easy obtainment of an image of excellent finish quality without silver sludge formation, photographic developer stain and roller/belt stain even when used at low replenishing rates in continuous processing of a large amount of light-sensitive material using an automatic processing machine.

It is another object of the present invention to provide a silver halide photographic light-sensitive material developer having a sludge-preventing effect without affecting the photographic performance. The other objects of the present invention will become obvious through the following description.

The above objects of the present invention are accomplished by the present invention described as follows:

The objects are accomplished by a developer for developing silver halide photographic light-sensitive material which contains a compound represented by the following formula 1 or 2:

Formula 1

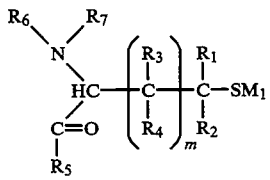

Formula 2

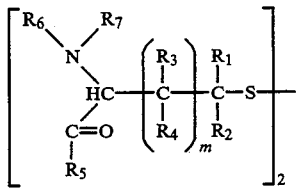

wherein $R_1$ and $R_2$ independently represent a hydrogen atom or an alkyl group having 1 to 3 carbon atoms. $R_1$ and $R_2$ are not hydrogen atoms at the same time. $R_3$ and $R_4$ independently represent a hydrogen atom or an alkyl group having 1 to 3 carbon atoms; $R_5$ represents a hydroxyl group, an amino group or an alkyl group having 1 to 3 carbon atoms. $R_6$ and $R_7$ independently represent a hydrogen atom, an alkyl group having 1 to 5 carbon atoms, an acyl group having up to 18 carbon atoms or a $-COOM_2$ group. $R_6$ and $R_7$ are not hydrogen atoms at the same time. $M_1$ represents a hydrogen atom, an aikali metal atom or an ammonium group, m represents 0, 1 or 2; and $M_2$ is a hydrogen atom, an alkyl group having 1 to 4 carbon atoms, an alkali metal atom, an aryl group or an aralkyl group having not more than 15 carbon atoms.

DETAILED DESCRIPTION OF THE INVENTION

The present invention is described in detail below. Alky groups having 1 to 4 carbon atoms as described above include a methyl group, an ethyl group, a propyl group and a butyl group.

Examples of acyl groups having up to 18 carbon atoms include an acetyl group and a benzoyl group. Examples of aralkyl groups having up to 15 carbon atoms include a benzyl group and a phenetyl group.

Aryl groups include a phenyl group and a naphthyl group.

Examples of alkali metal atoms for $M_1$ include sodium ion and potassium ion.

Although various methods of synthesis can be used to synthesize the above compounds of the present invention, Strecker's method of amino acid synthesis, known to be an amino acid synthesis method, can be used, wherein amino acid acetylation is achieved by alternate addition of alkali and acetic anhydride in an aqueous solution.

Examples of the compounds of the present invention, represented by formulas 1 and 2, respectively, are given below, which are not to be construed as limitative.

1

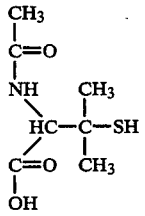

2

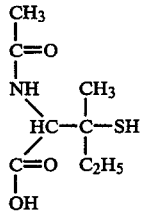

3

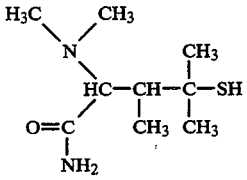

4

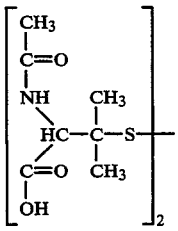

5

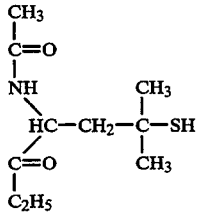

6

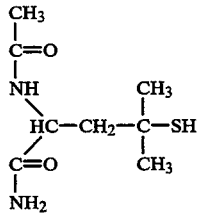

-continued

7

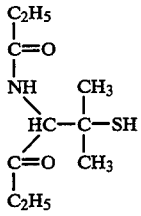

8

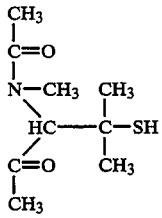

9

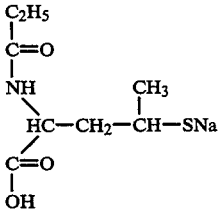

The above compounds of the present invention may be used singly or in combination. It is also acceptable to use in combination at least one kind of the compound of formula 1 and at least one kind of the compound of formula 2.

The inventive compounds of formulas 1 and 2 are used in amounts of $1\times10^{-5}$ to $3\times10^{-2}$ mol, preferably $1\times10^{-4}$ to $1\times10^{-2}$ mol per liter of developer. The replenishing rate for the developer containing a compound of the present invention is normally 0.05 to 0.65 l, preferably 0.10 to 0.35 l per $m^2$ of light-sensitive material, though it varies depending on the kinds of light-sensitive material, automatic processing machine, and other factors.

Preferably, the developing through drying processes are completed within 90 seconds when an automatic processing machine capable of developing, fixing and washing or stabilizing is used to process a silver halide light-sensitive material relating to the present invention.

In other words, the time from initiation of immersion of the tip of the light-sensitive material in the developer, via the various processes, to discharge of the same tip from the drying zone (what is called "dry to dry time") is preferably not longer than 90 seconds, more preferably not longer than 60 seconds.

Fixing temperature and time are preferably about 20° to 50° C. and 6 to 20 seconds, more preferably 30° to 40° C. and 6 to 15 seconds.

When the developer of the present invention is used, developing time is normally 5 to 45 seconds, preferably 8 to 30 seconds, and developing temperature is preferably 25° to 50° C., more preferably 30° to 40° C.

Drying may be achieved by hot air blow at normally 35° to 100° C., preferably 40° to 80° C. Alternatively, a drying zone equipped with a far infrared heating means may be arranged in the automatic processing machine.

The automatic processing machine may be equipped with a mechanism for adding either water or an acidic rinsing solution having no fixing capability to the light-sensitive material, among the above developing, fixing and washing processes such described as in Japanese Patent O.P.I. Publication No. 264953/199. The automatic processing machine may also have therein equipment for preparing developers and fixers.

The developer of the present invention preferably contains as a developing agent a 1,4-dihydroxybenzene compound or, if necessary, a p-aminophenol compound and/or a pyrazolidone compound.

1,4-dihydroxybenzenes include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and hydroquinone monosulfonate, with preference given to hydroquinone. p-aminophenol-based developing agents include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol, with preference given to N-methyl-p-aminophenol.

Examples of pyrazolidone compounds which can be used in the present invention include 1-phenyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone and 3-acetoxy-1-phenyl-3-pyrazolidone.

The amount of 1,4-dihydroxybenzene added is 0.01 to 0.7 mol, preferably 0.1 to 0.5 mol per liter of developer.

The amounts of p-aminophenol compound and pyrazolidone compound added are 0.0005 to 0.2 mol, preferably 0.001 to 0.1 mol per liter of developer.

Examples of sulfites used in the developer of the present invention include sodium sulfite, potassium sulfite, lithium sulfite, ammonium sulfite, sodium bisulfite and potassium metasulfite. The amount of these sulfites used is 0.1 to 2.0 mol, preferably 0.1 to 1.0 mol per liter of developer. Also, the upper limit is preferably 3.0 mol per liter of developer for a concentrated developer.

The developer may contain a chelating agent having an iron ion chelating stability constant of over 8. The iron ion mentioned herein is ferricion ($Fe^{3+}$).

Chelating agents having an iron ion chelating stability constant of over 8 include organic carboxylic acid chelating agents, organic phosphoric acid chelating agents, inorganic phosphoric acid chelating agents and polyhydroxyl compounds.

Specifically, such chelating agents include ethylenediamine-di-o-hydroxyphenylacetic acid, triethylenetetramineacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diamino-2-propanoltetraacetic acid, transcyclohexanediaminetetraacetic acid, ethylenediaminetetraacetic acid, glycol ether amine tetraacetic acid, ethylenediamine-N,N,N',N'-tetrakismethylenephosphonic acid, nitrilo-N,N,N-trimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate and sodium hexametaphosphate.

The developer of the present invention may contain a hardener which enhances the film physical properties by reacting with the gelatin in the light-sensitive material during the developing process. Examples of hardeners include glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-ethoxyglutaraldehyde, α-n-butoxyglutaraldehyde, α,α-dimethoxysuccinic dialdehyde, β-isopropylsuccinic dialdehyde, α,α-diethylsuccinic dialdehyde, butylmaleic dialdehyde and bisulfite adducts thereof.

In addition to these components, the developer may further contain developing inhibitors such as sodium bromide and potassium iodide, organic solvents such as ethylene glycol, diethylene glycol, triethylene glycol, dimethylformamide, methyl cellosolve, hexylene glycol, ethanol and methanol, mercapto compounds such as 1-phenyl-5-mercaptotetrazole and sodium 2-mercaptobenzimidazoie-5-sulfonate, and antifoggants such as 5-methylbenzotriazole and other benzotriazole compounds. Other additives such as toning agents, surfactants, defoaming agents may also be added as necessary.

The pH of the developer is normally 9.0 to 12, preferably 9.0 to 11.5. Examples of the alkali or buffer used for pH adjustment include pH regulators such as sodium hydroxide, potassium hydroxide, sodium carbonate, potassium carbonate, boric acid, sodium tertiary phosphate and potassium tertiary phosphate.

A fixer for fixing the light sensitive material may contain a fixing agent such as sodium thiosulfate or ammonium thiosulfate, with preference given to ammonium thiosulfate from the viewpoint of fixing speed. These fixing agents are usually used in amounts of about 0.1 to 6 mol/liter.

The fixer may also contain a water-soluble aluminum salt as a hardener, such as aluminum chloride, aluminum sulfate or potassium alum.

The fixer may incorporate malic acid, tartaric acid, citric acid, gluconic acid and derivatives thereof, singly or in combination. These compounds are effective when contained at not less than 0.001 mol per liter of fixer, with a greater effect obtained at 0.005 to 0.03 mol per liter of fixer.

Fixer pH is normally not lower than 3.8, preferably 4.2 to 7.0. In view of hardening in the fixer, sulfurous acid gas odor the pH is more preferably 4.3 to 4.8.

Silver halide photographic light-sensitive material emulsions to which the present invention is applicable include medical radiographic materials, photographic materials for printing plate making and direct positive photographic materials.

The silver halide photographic light-sensitive material to which the present invention is applied may be comprised a silver halide such as silver iodobromide, silver iodochioride or silver iodochlorobromide, with preference given to silver iodobromide from the viewpoint of high sensitivity.

Emulsions for the silver halide photographic light-sensitive material include monodispersed grains of high inner iodine content such as those disclosed in Japanese Patent O.P.I. Publication Nos. 177535/1984, 802237/1986, 132943/1986 and 49751/1988. Crystalline habit may be cubic, tetradecahedral or octahedral, and intermediate (111) and (100) planes may be present in any ratio.

The emulsion may be of tabular grains having an aspect ratio of not less than 2. Such tabular grains have advantages such as improvements in spectral sensitizing efficiency, image granularity and sharpness, and are disclosed in British Patent No. 2,112,157, U.S. Pat. Nos. 4,439,520, 4,433,048, 4,414,310 and 4,434,226, and Japanese Patent O.P.I. Publication Nos. 113927/1983, 127921/1983, 138342/1988, 284272/1988 and 305343/1988. The emulsion can be prepared as described in these publications.

Additives and other substances used in the silver halide photographic light-sensitive material include those described in Research Disclosure Nos. 17643 (December, 1978), 18716 (November, 1979) and 308119 (December, 1989) (hereinafter referred to as RD17643, RD18716 and RD308119, respectively). The following table shows where they are described.

| | RD17643 | | RD18716 | | RD308119 | |
|---|---|---|---|---|---|---|
| Item | Page | Category | Page | Category | Page | Category |
| Chemical sensitizer | 23 | III | 648, upper right | — | 996 | III |
| Sensitizing dye | 23 | IV | 648–649 | — | 996–998 | IV |
| Desensitizing dye | 23 | IV | — | — | 998 | B |
| Dye | 25–26 | VIII | 649–650 | — | 1003 | VIII |
| Developing accelerator | 29 | XXI | 648, upper right | — | — | — |
| Antifoggant/ Stabilizer | 24 | IV | 649, upper right | — | 1006–1007 | VI |
| Brightening agent | 24 | V | — | — | 998 | V |
| Hardener | 26 | X | 651, left | — | 1004–1005 | X |
| Surfactant | 26–27 | XI | 650, right | — | 1005–1006 | XI |
| Antistatic agent | 27 | XII | 650, right | — | 1006–1007 | XIII |
| Plasticizer | 27 | XII | 650, right | — | 1006 | XII |
| Lubricant | 27 | XII | — | — | — | — |
| Matting agent | 28 | XVI | 650, right | — | 1008–1009 | XVI |
| Binder | 26 | XXII | — | — | 1003–1004 | IX |
| Support | 28 | XVII | — | — | 1009 | XVII |

EXAMPLES

EXAMPLE 1

Preparation of Emulsions A, B and C

1) Preparation of seed emulsion

While maintaining a temperature of 60° C., a pAg of 8 and a pH of 2.0, monodispersed cubic grains of silver iodobromide having an average grain size of 0.3 μm and a silver iodide content of 2 mol % were prepared by the double jet method.

The resulting reaction mixture was desalinized at 40° C., using an aqueous solution of Demol-N (produced by Kao Atlas) and an aqueous solution of magnesium sulfate, after which it was re-dispersed in an aqueous gelatin solution, to yield a seed emulsion.

2) Grain growth from seed emulsion

Using the above seed emulsion, grains were grown as follows: First, the seed emulsion was dispersed in an aqueous gelatin solution being kept at 40° C. and aqueous ammonia and acetic acid were added to obtain a pH of 9.7. An aqueous solution of ammoniacal silver nitrate and an aqueous solution of potassium bromide and potassium iodide were then added to the dispersion by the double jet method, while maintaining a pAg of 7.3 and a pH of 9.7, to yield a layer containing 35 mol % silver iodide. Next, another aqueous solution of ammoniacal silver nitrate and an aqueous solution of potassium bromide were added by the double jet method.

Until 95% of the desired grain size was reached, the pAg was kept at 9.0, with the pH varied continuously over the range of 9.0 to 8.0. The pAg was then changed to 11.0, and while keeping the pH at 8.0, grains were grown up to the desired grain size. Subsequently, acetic acid was added to obtain a pH of 6.0, after which 400 mg of the anhydride of 5,5'-dichloro-9-ethyl-3,3'-di(3-sulfopropyl)oxacarbocyanine sodium salt was added per mol of silver halide. This mixture was then desalinized with the above aqueous solution of Demol-N and aqueous solution of magnesium sulfate, and then re-dispersed in a gelatin solution.

Monodispersed silver iodobromide emulsions A, B and C, comprising tetradecahedral grains with round tips having an average silver iodide content of 2.0 mol %, were thus prepared, which had average grain sizes of 0.40, 0.65 and 1.00 μm and variation coefficients of grain size distribution ($\sigma/\bar{r}$) of 0.17, 0.16 and 0.16, respectively, in which $\sigma$ is the standard deviation of grain size distribution and $\bar{r}$ is the average grain size.

Preparation of Emulsion D

1) Preparation of seed emulsion

A hexagonal tabular seed emulsion was prepared as follows:

| Solution A | |
|---|---|
| Ossein gelatin | 60.2 g |
| Distilled water | 20 l |
| Sodium salt of polyisopropylene-polyethyleneoxydissuccinate (10% aqueous ethanol solution) | 5.6 ml |
| KBr | 26.8 g |

-continued

| | |
|---|---|
| 10% $H_2SO_4$ | 144 ml |
| Solution B | 3500 ml |
| 2.5 N aqueous $AgNO_3$ solution | |
| Solution C | |
| KBr | 1029 g |
| KI | 29.3 g |
| Water was added to 3500 ml. | |
| Solution D | |
| 1.75 N aqueous KBr solution: amount required to obtain the silver potential shown below | |

64.1 ml of each of solutions B and C was added to solution A at 35° C. by the double jet method over a period of 2 minutes, using the mixer stirrer described in Japanese Patent Examined Publication Nos. 58288/1983 and 58289/1983, whereby nuclei were formed.

After stopping the addition of solutions B and C, the temperature of solution A was increased to 60° C. over a period of 60 minutes, and solutions B and C were again added by the double jet method at a flow rate of 68.5 ml/min over a period of 50 minutes, while keeping the silver potential (determined using a silver ion selective electrode in combination with a saturated silver-silver chloride electrode as a reference electrode) at +6 mV using solution D.

After completion of the addition, 3% KOH solution was added to obtain a pH of 6, followed by immediate desalinization and washing. The resulting emulsion was designated as seed emulsion Em 0. Electron microscopy revealed that this emulsion comprised hexagonal tabular silver halide grains not less than 90% by projected area of which had a ratio of the largest edge length to the shortest edge length of 1.0 to 2.0 and which tabular grains had an average thickness of 0.07 μm and an average diameter of 0.5 μm as of circle diameter.

Using the following four solutions, a tabular silver iodobromide emulsion D containing 1.53 mol % AgI was prepared.

| | |
|---|---|
| Solution A | |
| Ossein gelatin | 29.4 g |
| Seed emulsion Em 0 | Equivalent to 1.6 mol of AgI |
| Sodium salt of polyisopropylene-polyethyleneoxy-disuccinate (10% aqueous ethanol solution) | 2.5 ml |
| Distilled water was added to 1400 ml. | |
| Solution B | 2360 ml |
| 3.5 N aqueous $AgNO_3$ solution | |
| Solution C | |
| KBr | 963 g |
| KI | 27.4 g |
| Distilled water was added to 2360 ml. | |
| Solution D | |
| 1.75 N aqueous KBr solution: amount to obtain the silver potential shown below | |

Grains were grown at 60° C. by adding all of solutions S and C to solution A at a flow rate of 21.26 ml/min over a period of 111 minutes, using the mixer stirrer described in Japanese Patent Examined Publication Nos. 58288/1983 and 58289/1983 as above.

Throughout this operation, the silver potential was kept at +25 mV using solution D. After completion of the addition, the following spectral sensitizing dyes A and B were added in amounts of 300 mg and 15 mg, respectively, per mol of silver halide.

After the excess salts were removed by precipitation and desalinization with the same aqueous solutions of Demol-N and of magnesium sulfate as above, an aqueous solution of 92.2 g of ossein gelatin was added, and the mixture was stirred and re-dispersed.

A tabular silver iodobromide emulsion D having an average silver iodide content of 15 mol % , a projected area diameter of 0.96 μm, a coefficient of variation of 0.25 and an aspect ratio of 4.0 was thus prepared.

Sensitizing dye A: Anhydride of 5,5'-dichloro-9-ethyl-3,3'-di-(3-sulfopropyl)oxacarboxycyanine sodium salt Sensitizing dye B: Anhydride of 5,5'-di-(butoxycarbonyl)-1,1'-diethyl-3,3'-di-(4-sulfobutyl)benzimidazolocarbocyanine sodium salt

Sample Preparation

To each of the thus-obtained emulsions A, B, C and D, a 200:1 (w/w) mixture of the above sensitizing dyes A and B was added at 975 mg, 600 mg, 390 mg and 500 mg per mol of silver halide, respectively.

Ten minutes later, appropriate amounts of chloroauric acid, sodium thiosulfate and ammonium thiocyanate were added for optimum chemical sensitization. Fifteen minutes before completion of ripening, 200 mg of potassium iodide was added per mol of silver halide. Subsequently, $3\times10^{-2}$ tool of 4-hydroxy-6-methyl-1,3,3*a*,7-tetrazaindene was added per mol of silver halide, and this mixture was dispersed in an aqueous solution of 70 g of gelatin.

Of the four ripened emulsions, A, B and C were mixed in a weight ratio of 15:65:20, to yield emulsion I, while emulsion D, designated as emulsion II, was used as such.

To each emulsion, the following additives were added. The amounts of addition are shown per mol of silver halide.

| | |
|---|---|
| 1,1-dimethylol-1-bromo-1-nitromethane | 70 mg |
| t-butylcatechol | 400 mg |
| Polyvinylpyrrolidone (molecular weight 10,000) | 1.0 g |
| Styrene-maleic anhydride copolymer | 2.5 g |
| Trimethylolpropane | 10 g |
| Nitrophenyl-triphenylphosphonium chloride | 50 mg |
| Ammonium 1,3-dihydroxybenzene-4-sulfonate | 4 g |
| Sodium 2-mercaptobenzimidazole-5-sulfonate | 15 mg |
| 1-phenyl-5-mercaptotetrazole | 10 mg |
| $C_4H_9OCH_2CH(OH)CH_2N(CH_2COOH)_2$ | 1 g |
| 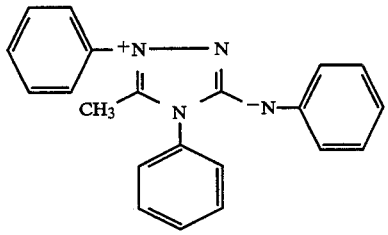 | 60 mg |
| 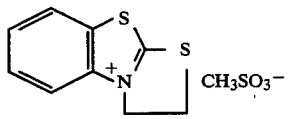 | 35 mg |
| Dye dispersion (see below) | 1.2 g |

Preparation of Dye Dispersion

Ten Kilograms of the following dye was dissolved in a mixed solvent of 28 l of tricresyl phosphate and 85 l of ethyl acetate at 55° C. This solution is designated as the oily solution.

Separately, 270 l of a 9.3% aqueous solution of gelatin containing 1.35 kg of an anionic surfactant as was prepared. This solution is designated as the aqueous solution. Next, the oily solution and the aqueous solution were placed in a dispersing vessel and dispersed while keeping the liquid temperature at 40° C. To the resulting dispersion were added appropriate amounts of phenol and 1,1-dimethylol-bromo-1-nitromethane, and water was added to 240 kg.

Dye

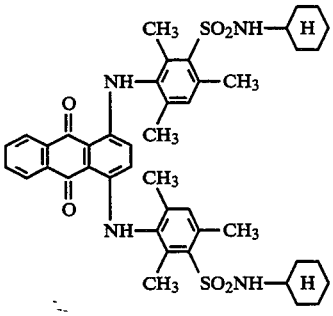

AS

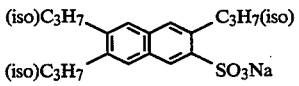

The composition of the protective layer are as follows: The amount of addition are shown per liter of coating solution.

| | |
|---|---|
| Inert lime-processed gelatin | 68 g |
| Acid-processed gelatin | 2 g |
| Sodium isoamyl-n-decylsulfosuccinate | 0.3 g |
| Polymethyl methacrylate (matting agent of area-average grain size of 3.5 μm) | 1.1 g |
| Silicon dioxide grains (matting agent of area-average grain size of 1.2 μm) | 0.5 g |
| Ludox AM (colloidal silica, produced by Du Pont) | 30 g |
| 40% aqueous solution of glyoxal (hardener) | 1.5 ml |
| Bis(vinylsulfonylmethyl) ether (hardener) | 500 mg |
| 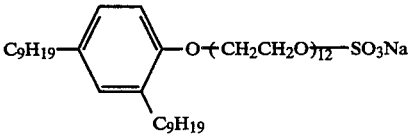 | 1.0 mg |
| 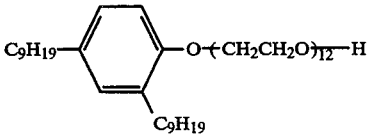 | 0.4 mg |
| $NaO_3S-CH(CH_2COOCH_2(C_2F_4)_3H)COOCH_2(C_2F_4)_3H$ | 0.5 mg |
| $C_{12}H_{25}CONH(CH_2CH_2O)_5H$ | 2.0 g |

The resulting coating solution was coated and dried uniformly on a blue-colored subbed polyethylene terephthalate film base 180 μm thick.

Using two slide hopper coaters, both the emulsion layer and the protective layer were coated simultaneously at a coating speed of 90 m per minute, to yield samples, wherein coating rates were 1.7 g/m$^2$ as of silver for the emulsion layer and 0.99 g/m$^2$ as of gelatin for the protective layer.

In Table 1, developing sample 1 was obtained from emulsion I, and developing sample 2 obtained from emulsion II.

The compositions of the developer and fixer used in the present invention are as follows:

Developer

| | |
|---|---|
| Part A (for 12 liter of finished solution) | |
| Potassium hydroxide | 450 g |
| Potassium sulfite (50% solution) | 2280 g |
| Diethylenetetraminepentaacetic acid | 120 g |
| Sodium hydrogen carbonate | 132 g |
| 5-methylbenzotriazole | 1.2 g |
| 1-phenyl-5-mercaptotetrazole | 0.2 g |
| Hydroquinone | 340 g |
| Water was added to 5000 ml. | |
| Part B (for 12 liter of finished solution) | |
| Glacial acetic acid | 170 g |
| Triethylene glycol | 185 g |
| 1-phenyl-3-pyrazolidone | 22 g |
| 5-nitroindazole | 0.4 g |
| Starter | |
| Glacial acetic acid | 120 g |
| Potassium bromide | 225 g |
| Water was added to 1000 ml. | |

Fixer

| | |
|---|---|
| Part A (for 18 liter of finished solution) | |
| Ammonium thiosulfate (70 w/v %) | 6000 g |
| Sodium sulfite | 110 g |
| Sodium acetate trihydrate | 450 g |
| Sodium citrate | 50 g |
| Gluconic acid | 70 g |
| 1-(N,N-dimethylamino)-ethyl-5-mercaptotetrazole | 18 g |
| Part B | 800 g |
| Aluminum sulfate | |

To prepare the developer, parts A and B were added at the same time to about 5 liters of water, and while stirring and dissolving the mixture, water was added to 12 liters, and glacial acetic acid was added to obtain a pH of 10.40, to yield a developer replenisher.

To this developer replenisher, the above starter was added at 20 ml/l, followed by pH adjustment to 10.26 before use.

To prepare the fixer, parts A and B were added at the same time to about 5 liters of water, and while stirring and dissolving the mixture, water was added to 18 liters, and sulfuric acid or NaOH were added to obtain a pH of 4.4, to yield a fixer replenisher.

Based on the above developer compounds of the present invention and comparative compounds were added as listed in Table 1 below to prepare developers, which were used for actual developing.

The following Comparative Compounds 1–12 were used as comparative compounds.

Comparative Compound 1: L-cysteine (free base)

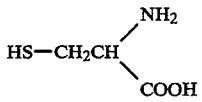

Comparative Compound 2: Cystine

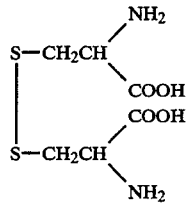

Comparative Compound 3: L-methionine

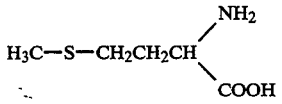

Comparative Compound 4: DL-penicillamine

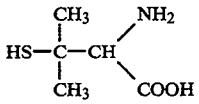

Comparative Compound 5: Acetylmethionine

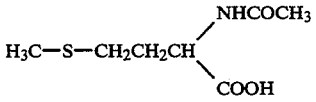

Comparative Compound 6: DL-ethionine

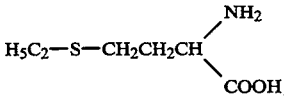

Comparative Compound 7: Mercaptoisobutyric acid

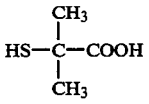

Comparative Compound 8:
β-phenyl-α-mercaptoacrylic acid

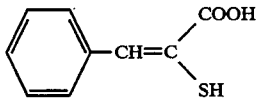

Comparative Compound 9: γ-isothioureidoubutyric acid

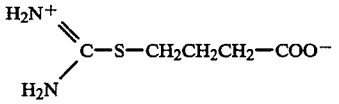

Comparative Compound 10: N-acetyl-L-cysteine

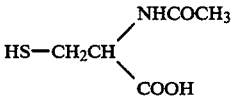

Comparative Compound 11: Homocysteine

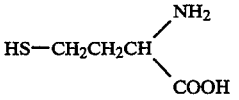

Comparative Compound 12: Isoleucine

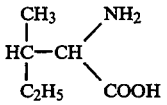

Developing was conducted using the roller transport automatic processing machines described below.

| Automatic processing machine No. | Model (produced by Konica Corporation) | Processing conditions |
|---|---|---|
| 1 | SRX-1001 | Dry to Dry, 45 sec. |
| 2 | SRX-502 | Dry to Dry, 45 sec. |
| 3 | SRX-251 | Dry to Dry, 65 sec. |

Processing temperatures were 35° C. for developing, 33° C. for fixation, 20° C. for washing and 50° C. for drying.

The samples were evaluated as follows:

1. Sensitometry

The sample, inserted between two sheets of fluorescent sensitizing paper KO-250, manufactured by Konica Corp., was subjected to exposure through an aluminum wedge of at a tube voltage of 80 kV, a tube amperage of 100 mA and an irradiation time of 50 msec, after which it was processed using the above automatic processing machines. With respect to the processed sample, the reciprocal of the exposure amount required to obtain a density of base density+fog density+1.0 was calculated as a percent sensitivity relative to the sensitivity of sample No. 1 processed with the above developer and fixer of basic composition using automatic processing machine No. 2 (experiment No. 15).

The density in the unexposed portion of the exposed sample was determined using Konica PDA-65 densitometer, and the base density was subtracted therefrom to obtain the fog density, and the maximum density was expressed as Dm.

2. Silver sludge evaluation

Next, developing samples, subjected to X-ray exposure to a density of 1.0 over the entire surface of the sample, were processed at a fixer replenishing rate of 300 cc/m$^2$ at 70 sheets per day for 30 consecutive days, using the above-described automatic processing machine Nos. 1, 2 and 3, wherein the developer replenishing rate and developing sample were changed as shown in Table 1.

The developing samples used were the above sample Nos. 1 and 2.

Upon processing, visual evaluation was made for possible stains on the developing rack, rollers and wall, and of the processed sample, in the following four grades:

A: Almost no silver sludge seen, with no stain on the rollers or wall.

B: Developer turbidity seen, with slight stain on the processing tank wall.

C: Silver sludge seen, with developing rack stain difficult to wash down.

D: Much silver sludge seen on the developer tank, causing image stain as a result of its adhesion to the film being processed.

3. Evaluation of Residual Silver

The above sample No. 2 was processed unexposed and evaluated for residual silver as follows:

One drop of a $2.6\times10^{-3}$ mol/l aqueous solution of sodium sulfide, as the residual silver evaluating solution, was dropped on a surface of the above residual silver evaluating film. Three minutes later, the solution was thoroughly wiped away, and the film was kept standing at normal temperature and normal humidity for 15 hours.

Then, using a PDA-65 densitometer (produced by Konica Corporation), blue light transmission densities were determined for the portion where the residual silver evaluating solution was dropped and the other portion. The difference of the densities was used as the index of residual silver. The residual silver concentration in the processed film increases as this difference increases.

The results are given in Tables 1 through 3 below.

TABLE 1

| Experiment No. | Automatic processing machine No. | Anti-silver sludge agent: Compound added | Anti-silver sludge agent: Amount of addition (mol/l) | Sensitometry: Relative sensitivity | Sensitometry: Dm | Residual silver | Developing sample | Developer replenishing rate (cc/m$^2$) | Silver sludge preventing effect |
|---|---|---|---|---|---|---|---|---|---|
| 1 (inventive) | 2 | No. 1 | 0.0005 | 100 | 3.43 | 0.01 | 1 | 650 | A |
| 2 (inventive) | 2 | No. 1 | 0.0005 | 100 | 3.45 | 0.00 | 1 | 325 | A |
| 3 (inventive) | 2 | No. 1 | 0.0005 | 100 | 3.40 | 0.02 | 1 | 200 | A |
| 4 (inventive) | 2 | No. 1 | 0.0005 | 100 | 3.50 | 0.01 | 2 | 650 | A |
| 5 (inventive) | 2 | No. 1 | 0.0005 | 100 | 3.46 | 0.01 | 2 | 325 | A |
| 6 (inventive) | 2 | No. 1 | 0.0005 | 100 | 3.49 | 0.00 | 2 | 200 | A |
| 7 (inventive) | 2 | No. 1 | 0.00025 | 100 | 3.48 | 0.00 | 2 | 200 | A |
| 8 (inventive) | 2 | No. 2 | 0.0005 | 100 | 3.48 | 0.00 | 2 | 650 | A |
| 9 (inventive) | 2 | No. 2 | 0.0005 | 100 | 3.45 | 0.02 | 2 | 325 | A |
| 10 (inventive) | 2 | No. 2 | 0.0005 | 100 | 3.46 | 0.02 | 2 | 200 | A |
| 11 (inventive) | 2 | No. 6 | 0.0005 | 100 | 3.45 | 0.00 | 2 | 325 | A |
| 12 (inventive) | 3 | No. 1 | 0.0005 | 100 | 3.46 | 0.00 | 2 | 200 | A |
| 13 (inventive) | 3 | No. 1 | 0.0005 | 100 | 3.45 | 0.01 | 2 | 325 | A |
| 14 (inventive) | 1 | No. 1 | 0.0005 | 100 | 3.46 | 0.00 | 2 | 200 | A |
| 15 (inventive) | 2 | No. 1 | 0.00025 | 100 | 3.42 | 0.01 | 2 | 200 | A |
| | | No. 4 | 0.00025 | | | | | | |

TABLE 2

| Experiment No. | Automatic processing machine No. | Anti-silver sludge agent: Compound added | Anti-silver sludge agent: Amount of addition (mol/l) | Sensitometry: Relative sensitivity | Sensitometry: Dm | Residual silver | Developing silver | Developer replenishing rate (cc/m$^2$) | Silver sludge preventing effect |
|---|---|---|---|---|---|---|---|---|---|
| 16 (comparative) | 2 | Not added | 0 | 100 | 3.46 | 0.10 | 1 | 650 | C |
| 17 (comparative) | 2 | Not added | 0 | 100 | 3.45 | 0.08 | 1 | 325 | D |
| 18 (comparative) | 2 | Not added | 0 | 100 | 3.45 | 0.09 | 1 | 200 | D |
| 19 (comparative) | 2 | Not added | 0 | 100 | 3.48 | 0.14 | 2 | 650 | C |
| 20 (comparative) | 2 | Not added | 0 | 100 | 3.46 | 0.09 | 2 | 325 | D |
| 21 (comparative) | 2 | Not added | 0 | 100 | 3.46 | 0.10 | 2 | 200 | D |
| 22 (comparative) | 2 | Comparative* 1 | 0.0005 | 90 | 2.90 | 0.11 | 2 | 650 | B |
| 23 (comparative) | 2 | Comparative 1 | 0.0005 | 90 | 2.91 | 0.10 | 2 | 325 | D |
| 24 (comparative) | 2 | Comparative 2 | 0.0005 | 90 | 3.01 | 0.09 | 2 | 650 | B |
| 25 (comparative) | 2 | Comparative 2 | 0.0005 | 90 | 3.05 | 0.10 | 2 | 325 | D |
| 26 (comparative) | 2 | Comparative 3 | 0.0005 | 83 | 3.03 | 0.11 | 2 | 650 | B |
| 27 (comparative) | 2 | Comparative 3 | 0.0005 | 83 | 2.95 | 0.11 | 2 | 325 | D |
| 28 (comparative) | 2 | Comparative 4 | 0.0005 | 86 | 2.93 | 0.10 | 2 | 650 | B |
| 29 (comparative) | 2 | Comparative 4 | 0.0005 | 86 | 2.93 | 0.09 | 2 | 325 | D |
| 30 (comparative) | 2 | Comparative 5 | 0.0005 | 81 | 3.12 | 0.10 | 2 | 650 | B |

Comparative*: Comparative compound

TABLE 3

| Experiment No. | Automatic processing machine No. | Anti-silver sludge agent: Compound added | Anti-silver sludge agent: Amount of addition (mol/l) | Sensitometry: Relative sensitivity | Sensitometry: Dm | Residual silver | Developing sample | Developer replenishing rate (cc/m²) | Silver sludge preventing effect |
|---|---|---|---|---|---|---|---|---|---|
| 31 (comparative) | 2 | Comparative 5 | 0.0005 | 81 | 3.12 | 0.10 | 2 | 325 | D |
| 32 (comparative) | 2 | Comparative 6 | 0.0005 | 82 | 3.02 | 0.15 | 2 | 650 | B |
| 33 (comparative) | 2 | Comparative 6 | 0.0005 | 82 | 3.02 | 0.20 | 2 | 325 | D |
| 34 (comparative) | 2 | Comparative 7 | 0.0005 | 80 | 2.89 | 0.13 | 2 | 650 | B |
| 35 (comparative) | 2 | Comparative 7 | 0.0005 | 80 | 2.89 | 0.10 | 2 | 325 | D |
| 36 (comparative) | 2 | Comparative 8 | 0.0005 | 90 | 2.91 | 0.08 | 2 | 650 | B |
| 37 (comparative) | 2 | Comparative 8 | 0.0005 | 90 | 2.93 | 0.12 | 2 | 325 | D |
| 38 (comparative) | 2 | Comparative 9 | 0.0005 | 95 | 3.15 | 0.13 | 2 | 650 | B |
| 39 (comparative) | 2 | Comparative 9 | 0.0005 | 95 | 3.15 | 0.14 | 2 | 325 | D |
| 40 (comparative) | 2 | Comparative 10 | 0.0005 | 88 | 2.87 | 0.11 | 2 | 650 | B |
| 41 (comparative) | 2 | Comparative 10 | 0.0005 | 88 | 2.86 | 0.10 | 2 | 325 | D |
| 42 (comparative) | 2 | Comparative 11 | 0.0005 | 81 | 2.94 | 0.09 | 2 | 650 | B |
| 43 (comparative) | 2 | Comparative 11 | 0.0005 | 81 | 2.94 | 0.10 | 2 | 325 | D |
| 44 (comparative) | 2 | Comparative 12 | 0.0005 | 80 | 2.88 | 0.12 | 2 | 650 | B |
| 45 (comparative) | 2 | Comparative 12 | 0.0005 | 80 | 2.88 | 0.10 | 2 | 325 | D |

As seen in these tables, according to the present invention, silver sludge is well prevented without photographic performance deterioration even at reduced developer replenishing rates.

Specifically, Table 1 shows that the addition of a compound of the present invention to the developer did not lower the sensitivity or Dm (maximum density), while the addition of a comparative compound significantly lowered the sensitivity, though it had a slight preventive effect on silver sludge at high replenishing rates.

Results of experiment Nos. 1 through 10 demonstrate that developers containing a compound of the present invention remain excellently effective without deterioration of the silver sludge preventing effect even when the replenishing rate is reduced to 200 ml/m². Also, the results of experiment Nos. 12 and 14 demonstrate that there is no difference in silver sludge preventing effect among different automatic processing machines.

An unexpected finding is that the present invention offers improved fixing performance with no residual silver.

What is claimed is:

1. The developer for developing a silver halide photographic light-sensitive material comprising a 1,4-dihydroxybenzene, a sulfite, and $1\times10^{-5}$ to $3\times10^{-2}$ mol per liter of a compound of Formula 1 or Formula 2, based on said developer, said developer having a pH of 9.0 to 12;

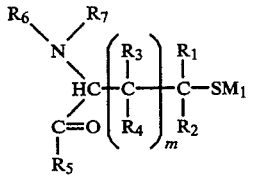

(1)

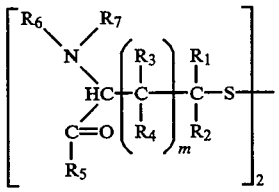

(2)

wherein $R_1$ and $R_2$ are each a hydrogen atom or an alkyl group having 1 to 3 carbon atoms provided that both of $R_1$ and R2 are not hydrogen atoms at the same time; $R_3$ and $R_4$ are each a hydrogen atom or an alkyl group having 1 to 3 carbon atoms; $R_5$ is a hydroxy group, an amino group or an alkyl group having 1 to 3 carbon atoms; $R_6$ and $R_7$ are each a hydrogen atom, an alkyl group having 1 to 5 carbon atoms, an acyl group having 1 to 18 carbon atoms or a —$COOM_2$ group, provided that both of $R_6$ and R7 are not hydrogen atoms at the same time, in the above $M_1$ is a hydrogen atom, an alkali metal atom or an ammonium group; m is an integer of 0, 1 or 2; and $M_2$ is a hydrogen atom, an alkyl group having 1 to 4 carbon atoms, an alkali metal atom, an aryl group or an aralkyl group having not more than 15 carbon atoms.

2. The developer of claim 1 wherein said developer contains said compound in an amount of $1\times10^{-4}$ to $3\times10^{-2}$ mol per liter.

3. The developer of claim 1 wherein said developer contains said 1,4-dihydroxybenzene in an amount of 0.01 mol to 0.7 mol per liter.

4. The developer of claim 3 wherein said developer contains said 1,4-dihydroxybenzene in an amount of 0.1 mol to 0.5 mol per liter.

5. The developer of claim 1 wherein said developer contains a p-aminophenol or a pyrazolidone.

6. The developer of claim 5 wherein said developer contains said p-aminophenol or said pyrazolidone in an amount of 0.0005 mol to 0.2 mol per liter.

7. The developer of claim 6 wherein said developer contains said p-aminophenol or said pyrazolidone in an amount of 0.001 mol to 0.1 mol per liter.

8. The developer of claim 1 wherein said sulfite is selected from the group consisting of sodium sulfite, potassium sulfite, lithium sulfite, and ammonium sulfite.

9. The developer of claim 1 wherein said developer contains said sulfite in an amount of 0.1 to 2.0 mol per liter of said developer.

10. The developer of claim 1 further containing a chelating agent having an iron ion chelating stability of over 8.

11. The developer of claim 1 further containing a development inhibitor, a mercapto compound, or an antifoggant.

12. The developer of claim 1 wherein $R_6$ or $R_7$ is an acetyl group or a benzoyl group; the aralkyl group represented by $M_2$ is a benzyl group or a phenethyl group; and the aryl group represented by $M_2$ is a phenyl group or a naphthyl group.

13. A developer for developing a silver halide photographic light-sensitive material comprising a compound represented by Formula 1 or Formula 2 in an amount of from $1\times10^{-4}$ to $3\times10^{-2}$ mol per liter, a 1,4-dihydroxybenzene in an amount of from 0.1 mol to 0.5 mol per liter, and a p-aminophenol or a pyrazolidone in an amount of from 0.001 mol to 0.1 mol per liter, all based on said developer;

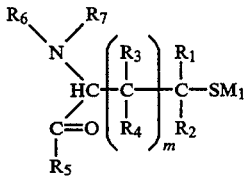

(1)

-continued

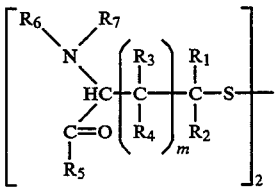

(2)

wherein $R_1$ and $R_2$ are each a hydrogen atom or an alkyl group having 1 to 3 carbon atoms provided that both of $R_1$ and $R_2$ are not hydrogen atoms at the same time; $R_3$ and $R_4$ are each a hydrogen atom or an alkyl group having 1 to 3 carbon atoms; $R_5$ is a hydroxy group, an amino group or an alkyl group having 1 to 3 carbon atoms; $R_6$ and $R_7$ are each a hydrogen atom, an alkyl group having 1 to 5 carbon atoms, an acyl group having 1 to 18 carbon atoms or a —$COOM_2$ group, provided that both of $R_6$ and $R_7$ are not hydrogen atoms at the same time, in the above $M_1$ is a hydrogen atom, an alkali metal atom or an ammonium group; m is an integer 0, 1 or 2; and $M_2$ is a hydrogen atom, an alkyl group having 1 to 4 carbon atoms, an alkali metal atom, an aryl group or an aralkyl group having not more than 15 carbon atoms.

* * * * *